US011469532B2

(12) United States Patent
Yasumoto

(10) Patent No.: US 11,469,532 B2
(45) Date of Patent: Oct. 11, 2022

(54) CONNECTOR AND METHOD FOR CONNECTING CONNECTOR

(71) Applicant: Junkosha Inc., Kasama (JP)

(72) Inventor: Hiromi Yasumoto, Kasama (JP)

(73) Assignee: Junkosha Inc., Kasama (JP)

( * ) Notice: Subject to any disclaimer, the term of this patent is extended or adjusted under 35 U.S.C. 154(b) by 92 days.

(21) Appl. No.: 16/645,538

(22) PCT Filed: Sep. 14, 2018

(86) PCT No.: PCT/JP2018/034312
§ 371 (c)(1),
(2) Date: Jul. 9, 2020

(87) PCT Pub. No.: WO2019/054513
PCT Pub. Date: Mar. 21, 2019

(65) Prior Publication Data

US 2021/0036454 A1 Feb. 4, 2021

(30) Foreign Application Priority Data

Sep. 14, 2017 (JP) ..... JP2017-177150

(51) Int. Cl.

| | |
|---|---|
| ***H01R 13/08*** | (2006.01) |
| ***H01R 13/207*** | (2006.01) |
| ***H01R 13/631*** | (2006.01) |
| ***H01R 13/641*** | (2006.01) |
| ***H01R 24/38*** | (2011.01) |

(52) U.S. Cl.
CPC ..... *H01R 13/08* (2013.01); *H01R 13/207* (2013.01); *H01R 13/631* (2013.01); *H01R 13/641* (2013.01); *H01R 24/38* (2013.01)

(58) Field of Classification Search
CPC .... H01R 13/08; H01R 13/207; H01R 13/631; H01R 13/641; H01R 13/622; H01R 24/38; H01R 24/525; H01R 9/0521; H01R 43/26
See application file for complete search history.

(56) References Cited

U.S. PATENT DOCUMENTS

| | | | | |
|---|---|---|---|---|
| 5,915,986 | A | 6/1999 | Maejima | |
| 6,056,570 | A | 5/2000 | Maejima | |
| 2003/0092317 | A1* | 5/2003 | Kooiman | H01R 13/622 439/578 |
| 2004/0038578 | A1* | 2/2004 | Weigel | H01R 13/622 439/320 |
| 2010/0255721 | A1 | 10/2010 | Purdy et al. | |
| 2013/0029522 | A1 | 1/2013 | Holliday et al. | |
| 2017/0294740 | A1* | 10/2017 | Tsukahara | H01R 24/38 |

FOREIGN PATENT DOCUMENTS

| | | | |
|---|---|---|---|
| DE | 19650098 | A1 | 6/1997 |
| JP | 1459511981 | A | 4/1983 |
| JP | S59101376 | U | 7/1984 |
| JP | S60172185 | A | 9/1985 |

(Continued)

*Primary Examiner* — Abdullah A Riyami
*Assistant Examiner* — Nader J Alhawamdeh
(74) *Attorney, Agent, or Firm* — The Webb Law Firm

(57) ABSTRACT

The present disclosure is directed to an internal conductor configured as a movable element, thereby providing a connector for preventing the occurrence of the breakdown or damage of a pin of a male connector.

9 Claims, 10 Drawing Sheets

(56) References Cited

FOREIGN PATENT DOCUMENTS

| | | | |
|---|---|---|---|
| JP | H6140107 | A | 5/1994 |
| JP | H06140107 | A | 5/1994 |
| JP | H8045609 | A | 2/1996 |
| JP | H08045609 | A | 2/1996 |
| JP | H0920871 | A | 5/1997 |
| JP | H9120871 | A | 5/1997 |
| JP | H10334983 | A | 12/1998 |
| JP | 2004079425 | A | 3/2004 |
| JP | 2005071994 | A | 3/2005 |
| WO | 9963629 | A1 | 12/1999 |
| WO | 2012138644 | A2 | 10/2012 |

* cited by examiner

CONNECTOR AND METHOD FOR CONNECTING CONNECTOR

CROSS-REFERENCE TO RELATED APPLICATIONS

This application is the United States national phase of International Application No. PCT/JP2018/034312 filed Sep. 14, 2018, and claims priority to Japanese Patent Application No. 2017-177150 filed Sep. 14, 2017, the disclosures of which are hereby incorporated by reference in their entirety.

BACKGROUND OF THE INVENTION

Technical Field

The present invention relates to a connector and a connecting method of the connector.

Background Art

In the related art, generally, examples of a widely known connector (for example, an SMA connector) include a screwing-type connector where a male connector (a plug) and a female connector (a socket) may be connected to each other by screwing therebetween. As illustrated in FIG. 12, a connector 100 includes a male connector 101 and a female connector 110, a screw thread 111*a* is provided on an outer circumference surface of an end portion 111 of the female connector 110, and moreover, a screw thread 102*a* corresponding to the screw thread 111*a* of the female connector 110 is provided on an inner circumference surface of a rotatable hexagonal-nut-shaped coupling nut 102 of the male connector 110. The coupling nut 102 is installed to rotate through a C ring (not shown). In connecting, the male/female connectors 101 and 110 are connected to each other so that a pin 103 of the male connector 101 is inserted into a pin hole 112 of the female connector 110, and then, the screw thread 102*a* of the male connector 101 and the screw thread 111*a* of the female connector 110 are screwed to each other by fastening the coupling nut 102, whereby the both connectors 101 and 110 are connected to each other.

Technical Problem

However, in the connector, there is a case where the breakdown or damage of a pin of a male connector occurs in connecting of the connector.

The present invention is provided based on the above-described technical problem, and an object thereof is to provide a connector and a connecting method of the connector, which be able to use a general female connector as it is and prevent the occurrence of breakdown or damage.

SUMMARY OF THE INVENTION

A connector of the present invention is a connector including a connection part connected to another connector at one end thereof and a cable connection part connected to a cable at the other end thereof, wherein the connection part is characterized by including an electrical connection part including an internal conductor including a pin elongating in a first direction and a physical connection part provided outside the electrical connection part to fix a relative position with respect to the other connector in connecting the connector 10 to the other connector, and the electrical connection part is configured to movable in the first direction with respect to the physical connection part.

Moreover, the connector is characterized in that the connector may be shifted from a first state, where a distance from a front end of the connection part to a front end of the pin is a first distance, to a second state where a distance from the front end of the connection part to the front end of the pin is a second distance less than the first distance.

Moreover, the connector is characterized in that the pin includes a pin body part and a pin front end portion provided at a front end side of the pin body part to a diameter reduced by the pin body part and a difference between the first distance and the second distance is greater than a length of the pin front end portion in the first direction.

Moreover, the connector is characterized in that a difference between the first distance and the second distance is greater than a length of the pin in the first direction. Also, the connector is characterized by further including a first lock mechanism maintaining the first state. Also, the connector is characterized by further including a second lock mechanism maintaining the second state.

Moreover, the connector is characterized in that the physical connection part includes a thread part and is configured to be screwed with the other connector by rotating the physical connection part in a first rotational direction. Also, the connector is characterized by further including a state display means displaying the first state and/or the second state of the connector.

Moreover, a connecting method of a connector is characterized by including preparing a first connector including one end, the other end, an internal conductor moving forward or backward with respect to a side of the one end, and a physical connection part provided near the internal conductor, preparing a second connector including one other internal conductor and one other physical connection part, connecting the physical connection part of the first connector to the one other physical connection part of the second connector to fix a relative position of the first connector and the second connector, and moving forward the internal conductor of the first connector to electrically connect the internal conductor of the first connector to the one other internal conductor of the second connector.

Moreover, the connecting method is characterized in that the fixing of the relative position of the first connector and the second connector includes placing the first connector and the second connector on the same axis.

Moreover, the connecting method is characterized in that the fixing of the relative position of the first connector and the second connector does not include electrically connecting the internal conductor of the first connector to the one other internal conductor of the second connector.

DETAILED DESCRIPTION OF THE INVENTION

The following embodiments do not limit claims of the present invention, and moreover, all combinations of features described in embodiments may not be essential for accomplishing the present invention. Hereinafter, the embodiments will be described with reference to the accompanying drawings. Also, a connector of an embodiment disclosed below is used for, for example, connecting a cable to a device body including a transmission/reception unit or an operational unit.

Figure 1A:
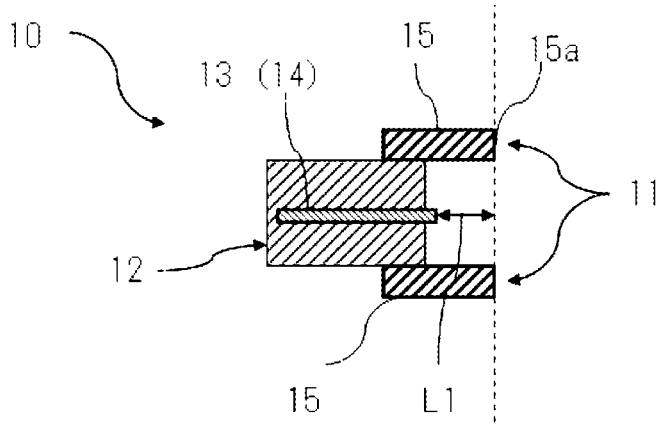
FIG. 1*a* is a schematic cross-sectional view of the present invention.
Figure 1B:
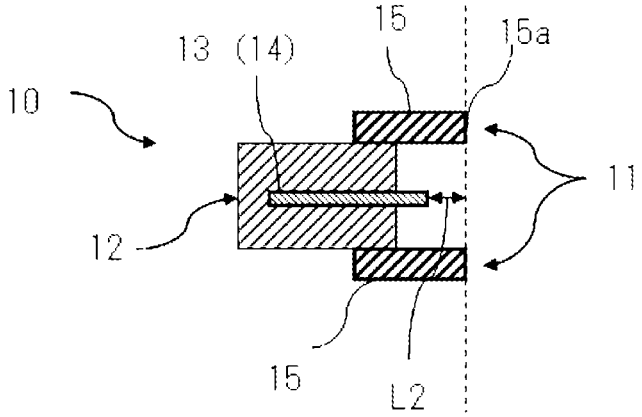
FIG. 1*b* is a schematic cross-sectional view of the present invention.

First, the principle (gist) of the present invention will be briefly described for helping understand the present invention. FIG. 1 is a schematic cross-sectional view for describing the principle (gist) of the present invention. Also, in FIG. 1 (*a*) and FIG. 1 (*b*), like reference numerals refer to like elements, and like elements will be described by using like hatchings. A connector 10 illustrated in the drawing includes a connection part 11 connected to another connector (not shown) at one end (a right end of the drawing) thereof and a cable connection part 12 connected to a cable (not shown) at the other end (a left end of the drawing) thereof. The connection part 11 includes an electrical connection part 14 which includes an internal conductor including a pin 13 elongating in a first direction (a left-right direction of the drawing) and a physical connection part 15 which is provided outside (outside in a diameter direction in the drawing) the electrical connection part 14 and fixes a relative position with respect to another connector in connecting the connector 10 to the other connector. The electrical connection part 14 includes a pin 13 inserted into a pin hole of the other connector. Based on the insertion, a connection may be performed so as to enable a current or an electrical signal to be transmitted between the pin 13 of the connector of the present invention and a pin hole of the other (connected) connector. The number of pins is not limited to one, and the connector 10 may include a plurality of pins.

The physical connection part may fix a relative position of the connector of the present invention with respect to another connector, and various fixing methods such as welding, attachment, clamp, and fitting may be applied thereto. However, it is preferable to select a method suitable for a fixing method originally provided by another connector, and for example, fixing based on screwing is suitable in terms of general use, fixing strength, and fixing workability. Also, a case where a physical connection includes a function of an electrical connection is not excluded, and for example, the physical connection may include a function corresponding to a path of a ground connection with another connector or a second signal path differing from a signal transmitted to the pin 13.

The cable includes at least one conductor line and is electrically connected to the pin 13. Also, the cable may include an insulation layer provided at an outer circumference of the at least one conductor line mainly and an outer conductor layer including a conductor provided at an outer circumference of the insulation layer mainly.

Moreover, as illustrated in the drawing (a) or the drawing (b), the electrical connection part 14 is configured to be movable in a first direction (a left-right direction of the drawing) with respect to the physical connection part 15 and/or the cable connection part 12. Based on such a configuration, in a case which connects the connector 10 to another connector, the physical connection part 15 of the connector 10 may be connected to the other connector, a relative position with respect to the other connector may be fixed, and subsequently the electrical connection part 14 may move in a first direction of the other connector, thereby performing an electrical connection with the other connector. In a related art connector, in connecting the connector to another connector, since adjustment of a position for a physical connection and adjustment of a position for an electrical connection are simultaneously performed, there is a case where the connector is damaged because a pin contacts a portion other than a pin hole of the other connector before or when adjusting a position relationship between the connector and the other connector to an appropriate position.

In order to solve such a problem, in the connector of the present invention, the connector 10 and another connector may be fixed in an appropriate position relationship and then the electrical connection part 14 may be connected to the other connector, and thus, the occurrence of the breakdown or damage of the electrical connection part 14 including the internal conductor including the pin 13 may be prevented in connecting the connector. As an example of the appropriate position relationship, a relationship where an axis of the pin 13 passes through a range of an inlet of a pin hole of the other connector is preferable, and a relationship where the axis of the pin 13 overlaps an axis of the pin hole is further preferable. Also, a state where a distance between a front end of the pin and a front end of the pin hole of the other connector is good.

Moreover, in disconnecting the connector, first, the electrical connection part 14 moves in a second direction (in a left direction of the drawing) opposite to the other connector in a state where a relative position with respect to the other connector is fixed, and a connection between the other connector and the electrical connection part 14 is released. Subsequently, a connection of the physical connection part 15 of the connector is released from the other connector. Therefore, a connection between the electrical connection part 14 and the other connector may be released in a state where a relative position between the connector 10 and the other connector is fixed, and the occurrence of the breakdown or damage of the electrical connection part 14 including the internal conductor including the pin 13 may be prevented in disconnecting the connector.

Moreover, the connector 10 may be shifted from a first state, where a distance from a front end 15*a* of the physical connection part 15 to a front end of the pin 13 is a first distance L1 as illustrated in the drawing (a), to a second state where a distance from a front end 11*a* of the connection part 11 to the front end of the pin 13 is a second distance L2 less than the first distance as illustrated in the drawing (b). Therefore, as described above, the occurrence of the breakdown or damage of the electrical connection part 14 may be prevented in connecting or disconnecting the connector to or from the other connector.

Figure 2A:
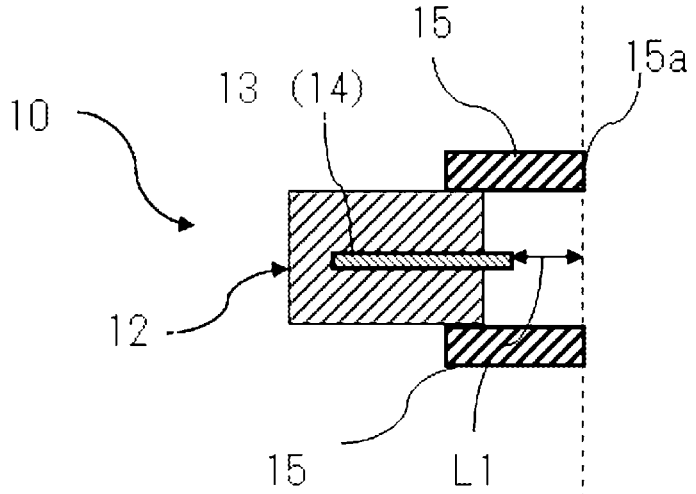
FIG. 2*a* is a schematic cross-sectional view of the present invention.
Figure 2B:
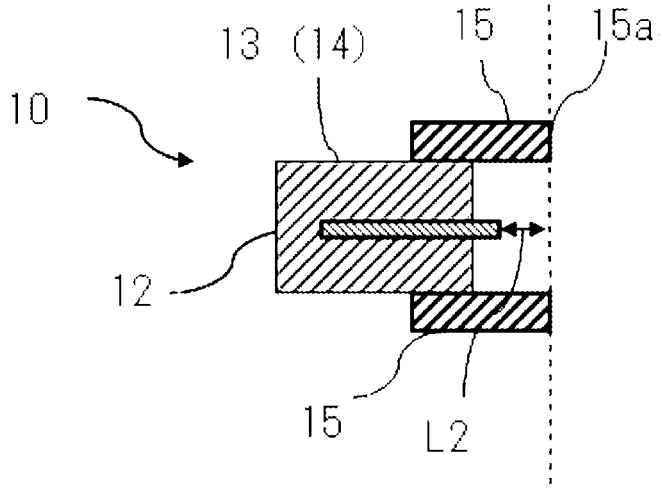
FIG. 2*b* is a schematic cross-sectional view of the present invention

Moreover, in the drawing, an example where the electrical connection part 14 moves with respect to the physical connection part 15 and the cable connection part 12 is illustrated, but as illustrated in FIG. 2, the physical connection part 15 may move with respect to the electrical connection part 14 and the cable connection part 12 or a combination thereof may be implemented.

Moreover, the electrical connection part may further include a second electrical connection part (not shown) which is electrically insulated from the pin 13 and includes an electrical contact surface vertical to an axial direction of the pin 13. The second electrical connection part may be electrically connected to the outer conductor layer of the cable and may provide an electrical connection path differing from an electrical connection path based on the pin and the pin hole in connecting the connector to the other connector. The second electrical connection part may move forward or backward in synchronization with the pin 13, or a position with respect to the physical connection part 15 may be fixed.

Figure 3:
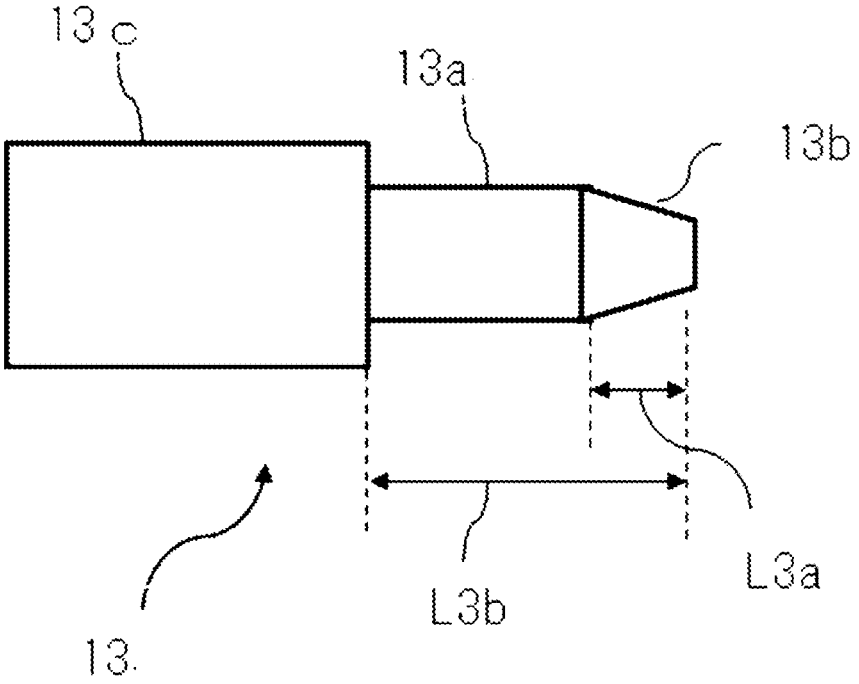
FIG. 3 is a schematic cross-sectional view of the present invention.
Figure 4A:
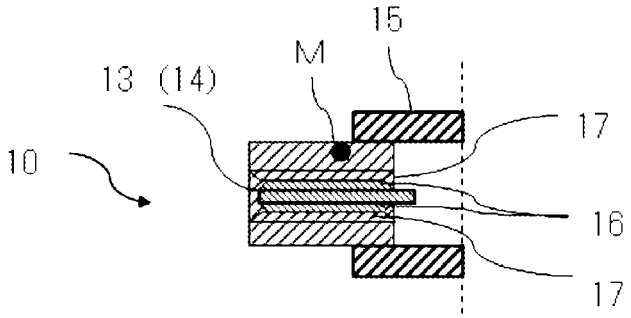
FIG. 4*a* is a schematic cross-sectional view of the present invention.
Figure 4B:
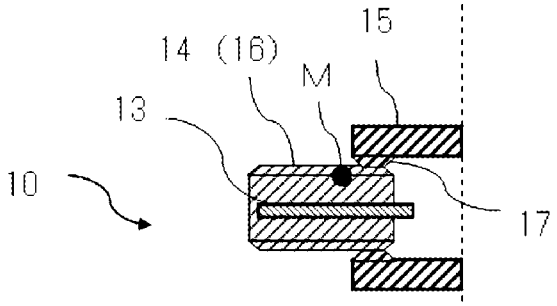
FIG. 4*b* is a schematic cross-sectional view of the present invention.
Figure 4C:
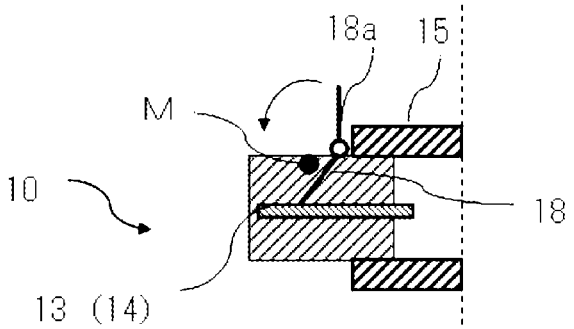
FIG. 4*c* is a schematic cross-sectional view of the present invention.
Figure 4D:
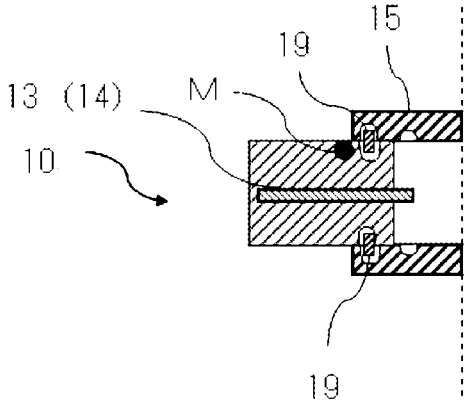
FIG. 4*d* is a schematic cross-sectional view of the present invention.

Moreover, as illustrated in FIG. 3, the pin 13 may include a pin body part 13*a* including an electrical contact point with the other connector at a side surface thereof. Also, the pin 13 may include a pin front end portion 13*b* which is provided at a front end side (a right side of the drawing) of the pin body part 13*a* and has a diameter reduced by the pin body part. The drawing illustrates a structure where a diameter of the pin front end portion 13*b* is reduced in a taper shape, but the pin front end portion 13*b* may have the diameter which is gradually reduced in steps, or for example, may have a shape where a cross-sectional surface thereof is provided to be curved like a semispherical shape. The pin front end portion 13*b* has a length L3*a* in the axial direction of the pin 13. In such a configuration, a difference (L1–L2) between the first distance L1 and the second distance L2 described above may be greater than the length L3*a* in the axial direction of the pin 13 of the pin front end portion 13*b*. Therefore, the damage of the pin front end portion 13*b* which is thinner than the pin body part 13*a* and is difficult to secure stiffness may be prevented.

Moreover, it is preferable that the difference (L1–L2) between the first distance L1 and the second distance L2 described above is greater than a diameter (a maximum value in a case having a plurality of diameters) of the pin body part 13*a*. Here, in a case where a diameter of the pin body part 13*a* is 1.3 mm or less, it is preferable to apply the present invention from a stiff surface thereof, and moreover, in a case where a diameter of the pin body part 13*a* is 0.6 mm or less, it is preferable to apply the present invention.

Moreover, the pin 13 may be installed on a pin supporting part 13*c* to stand. The pin supporting part 13*c* may be formed of, for example, an insulating material including resin and the like near a conductive member having the same diameter as that of the pin body part 13*a*. Alternatively, the pin supporting part 13*c* may be provided as a conductive member having a diameter which is greater than that of the pin body part 13*a*, and an insulating layer including an air layer may be provided near the pin body part 13*a*. That is, the pin supporting part 13*c* has high stiffness corresponding to stress in a vertical direction along an axis with respect to the pin 13. In such a configuration, the difference (L1–L2) between the first distance L1 and the second distance L2 described above may be greater than a sum length L3*b* of the pin front end portion 13*b* and the pin body part 13*a* in the first direction. Accordingly, the damage of the pin body part 13*a* difficult to secure stiffness compared to the pin supporting part 13*c* may be prevented.

FIG. 4 is a diagram exemplarily illustrating a lock mechanism for maintaining the first state and/or the second state of the connector 10, FIG. 4 (*a*) and FIG. 4 (*b*) illustrate a configuration where an axial-direction maintenance position may be locked based on screwing of a screw thread 16 and a screw groove 17 respectively provided in the electrical connection part 14 and the physical connection part 15, FIG. 4 (*c*) illustrates a configuration where an axial-direction maintenance position may be locked based on an opening/closing operation of a lever 18, and FIG. 4 (*d*) illustrates a configuration where a state may be locked by using a locking member 19 having a ring shape. Here, a configuration where all of the first state and the second state are locked in an axial direction is illustrated, but a configuration where one of the first state and the second state is lockable may be provided.

Here, the lock mechanism for maintaining the first state and/or the second state may be a means which is capable of being fixed so that a shift from the first state to the second state and/or a shift from the second state to the first state does not occur in external stress or a vibration occurring in transporting, attaching, or use. Alternatively, the lock mechanism may be a means which is capable of being fixed to a degree which needs specific manipulation and/or external stress having a certain value or more because a state is shifted.

Moreover, the electrical connection part 14 is an element capable of being shifted to the first state and/or the second state and may be configured by screwing of a rotator as illustrated in the drawing (a) and the drawing (b). In such a configuration, even when axial-direction external stress is applied to the electrical connection part 14 or the physical connection part 15, a change to a rotational motion with respect to an axis may be needed in shifting a state, and thus, a state may be maintained. Also, the connector is excellent in that a relative position relationship between the electrical connection part 14 and the physical connection part 15 may be controlled without step and it is possible to adjust a contact pressure of the electrical connection part 14 and a connection part corresponding to the other connector. For example, the connector is suitable for a case where the electrical connection part 14 includes an external conductor near the pin 13 and a contact surface of the external conductor includes a vertical component with respect to an axis. Also, a configuration where one of the electrical connection part 14 and the physical connection part 15 includes a thread (a screw thread 17) is illustrated in the drawing (a) and the drawing (b), but the present invention is not limited thereto and a configuration, where a state shift means where one of the electrical connection part 14 and the physical connection part 15 includes a thread is separately set and the other moves based on movement of the state shift means, may be provided.

Moreover, in the drawing (c) and the drawing (d) described below, it is preferable that the cable connection part 12 is configured to rotate based on the electrical connection part 14 and/or the physical connection part 15.

Moreover, as illustrated in the drawing (c) and the drawing (d), a maintaining mechanism which fixes a relative position of the electrical connection part 14 and the physical connection part 15 at a predetermined position may be provided. The drawing (c) illustrates an example of a configuration which uses the lever 18. The drawing (c) illustrates a state where the electrical connection part 14 has relatively retreated with respect to the physical connection part 15, and the state may be shifted to a state where the electrical connection part 15 has relatively moved forward, based on an operation of laying a handle part 18*a* of the lever 18 to the left as illustrated by an arrow. The lever 18 may be configured to be locked by the first state and the second state. A means of a lock may use a known method. For example, the lock mechanism may include an elastically deformable member, and compression (or pull) stress based on an elastic body of the lock mechanism may be configured so that the stress in the first state and/or the second state is less than the stress in a state of a state shifting process. The drawing (d) illustrates a locking member 19 having a ring shape and a mechanism which locks a state by using a plurality of concave portions which enable the locking member 19 to move in or out. The locking member may be elastically deformed by adding axial-direction external stress greater than a certain value, and thus, may be coupled to a concave portion differing from an original concave portion to be shifted to a different state and may be locked in the state. The locking member 19 may not have a complete ring shape and is preferable to have a C ring where a portion thereof is not provided. Also, the locking member 19 may be configured with one or more pins. Also, the present invention is not limited to the elastic deformation of the locking member, and the locking member 19 may include an elastic member. For example, the locking member 19 may include a spring and may be configured so that a front end of a pin biased by the spring moves into or out from a concave portion.

Moreover, as illustrated by adhesion M in the drawing, a state display means representing a case which is in the first state and/or the second state may be installed. FIG. 4 (*a*) and FIG. 4 (*b*) illustrate a configuration which is movable in an axial direction through screwing of a screw, but when movement in the first and/or second direction is controlled, the state display of a line or a concave portion seen with eyes from an external appearance may be provided in the electrical connection part or the physical connection part. Also, FIG. 4 (*c*) illustrates a configuration which is movable in an axial direction through an opening/closing operation of the lever, but when movement in the first and/or second direction is controlled, the state display of a line or a concave portion seen with eyes from an external appearance may be provided in the electrical connection part or the physical connection part. Also, FIG. 4 (*d*) illustrates a configuration which is movable in an axial direction by the locking member 19 having a ring shape disposed in parallel in the axial direction, but when movement in the first and/or second direction is controlled, the state display of a line or a concave portion seen with eyes from an external appearance may be provided in the electrical connection part or the physical connection part. Based on such configurations, the connector being in the first state or the second state may be easily checked with eyes, and an abnormal manipulation of an operator may be prevented. Even after connectors are connected, whether an electrical connection is normally performed may be easily determined from an external appearance, and moreover, the occurrence of the breakdown or damage of the connector may be better prevented.

Figure 5:
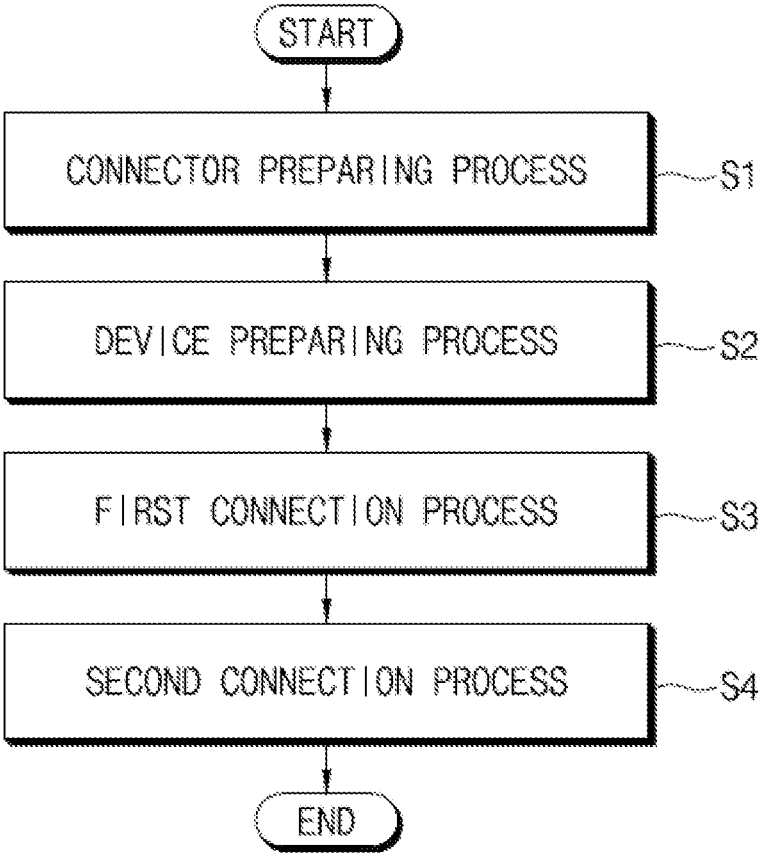
FIG. 5 is a flowchart illustrating a connecting method of the present invention.

FIG. 5 is a flowchart illustrating a connecting method of the present invention. First, a first connector which includes a physical connection part and an electrical connection part including an internal conductor including a pin is prepared (process S1). Subsequently, a second connector connectable to the first connector or a device including the second connector is prepared (process S2). Subsequently, the first connector is connected to the second connector by the physical connection part of the first connector. Therefore, a relative position of the first connector and the second connector is fixed (process S3). Subsequently, the electrical connection part of the first connector is electrically connected to an electrical connection part of the second connector (process S4).

Here, it is preferable that a pin position of the first connector in process S1 is a state (hereinafter referred to as an ⌈initial state⌋) where the pin is at a position which is physically connected to the second connector in process S3 but is not electrically connected thereto. A state checking process of checking that the pin position of the first connector is in an initial state may be provided. It is further preferable that the state checking process checks a state display means (the above-described concave portion, line, a position of the lever, or the like) in the first connector with eyes. Also, it is preferable that a lock process of locking an initial state of the first connector is provided before process S1. Therefore, a physical connection between the first connector and the second connector may be performed while certainly maintaining the initial state of the first connector. Also, an electrical connection may not be performed in physically connecting the first connector to the second connector, and the breakdown and damage of the pin may be prevented before a relative position of the first and second connectors is fixed in performing a physical connection.

Moreover, in the state checking process, when the first connector is not in the initial state, a state of the first connector may be shifted to the initial state. Also, in the state checking process, it may be checked that the breakdown or damage of the pin of the prepared first connector caused by the bending, folding, or crushing of the first connector does not occur. An operation of physically or electrically connecting to the broken-down or damaged first connector is a cause of the breakdown or damage of the second connection in addition to that a risk of a connection defect is very high. Therefore, by performing the state checking process, a risk of a connection defect may be prevented, and the breakdown or damage of the second connector may be prevented. Also, it is preferable that a pin hole checking process of checking a pin hole, corresponding to the pin of the first connector prepared in process S1, in the prepared second connector is included in process S2. Also, it is preferable that a pin hole position checking process of checking the pin hole is disposed at a position connectable to the pin of the first connector is included therein.

Moreover, it is preferable that a position adjusting process of adjusting positions of the first and second connectors to be physically connected on the same axis is included in process S3. Also, it is preferable that a physical connection state checking process of checking that the first and second connectors are physically connected so that a relative position of both connectors is fixed is included therein. Therefore, in process S4, a risk of rattling or staggering of a position relationship therebetween when electrically connecting the first connector to the second connector may decrease, and the pin may be accurately inserted into and unloaded from the pin hole in performing an electrical connection and releasing the electrical connection, thereby reducing the breakdown or damage of the pin.

Moreover, process S3 may further include a state checking process of checking that the first connector maintains the initial state in a state where the first connector is physically connected to the second connector. The state checking process may be easily performed as a process of checking the state display means in the first connector.

Moreover, process S4 may further include a position adjusting process of connecting the physical connection parts of the physically-connected first and second connectors on the same axis. Also, process S4 may further include a lock process of fixing, by the first connector, a relative position of the physical connection part and the electrical connection part in a state where an electrical connection has been performed.

Moreover, a device or a system having excellent connection reliability may be manufactured by performing an in-device connection and/or an inter-device connection by using a manufacturing method of the present invention.

Figure 6:
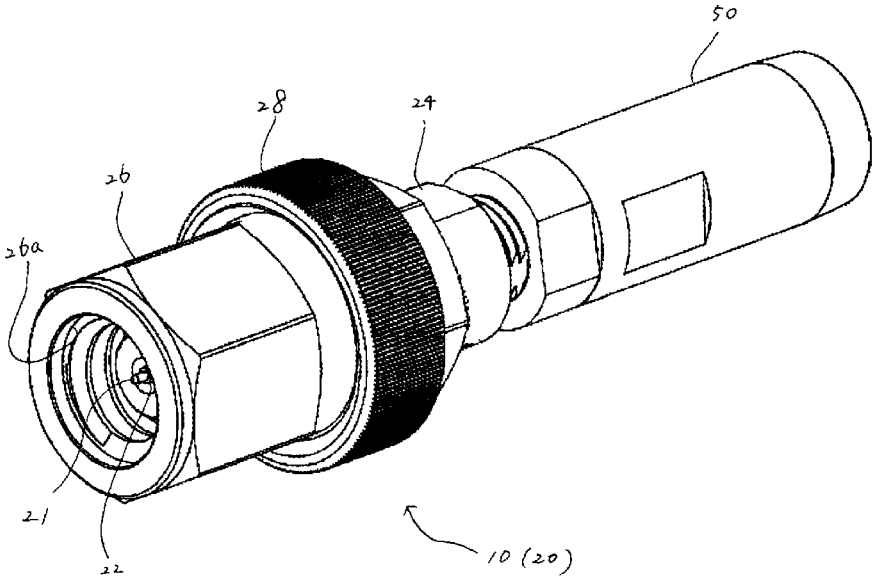
FIG. 6 is a perspective view illustrating a connector according to an embodiment of the present invention.
Figure 7:
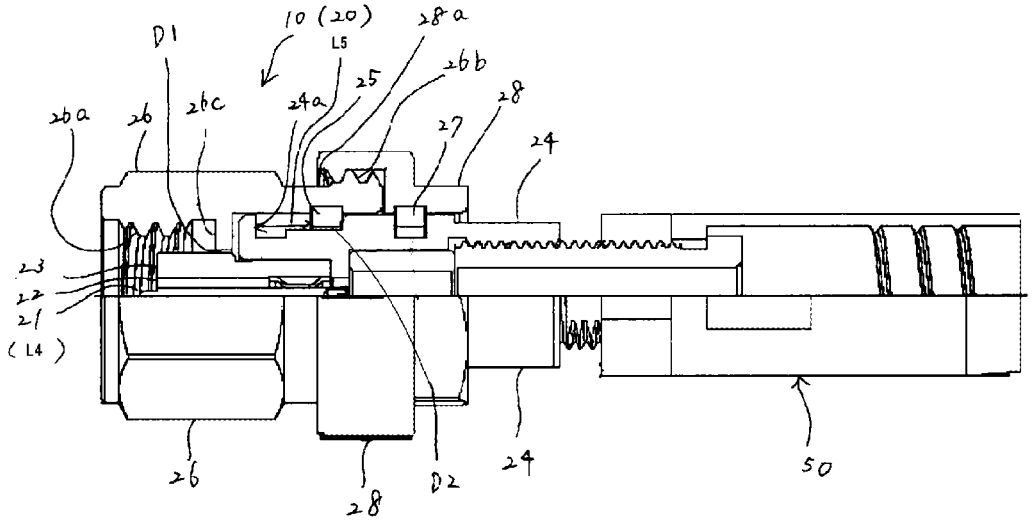
FIG. 7 is a side view illustrating a connector according to an embodiment of the present invention.

FIGS. 6 and 7 are diagrams illustrating a configuration of a connector of the present invention, FIG. 6 is a perspective view of a connector (a male connector), and FIG. 7 is a side view of the connector (the male connector) and partially illustrates a cross-sectional surface.

As illustrated in FIGS. 6 and 7, a connector 10 of the present embodiment is a male connector 20 including a pin. The male connector 20 includes a pin 21, which is installed at an end portion of a cable connection part 50 and elongates from a central conductor of the cable connection part 50, and a pin supporting member 22 which supports the pin 21. Also, the pin 21 protrudes from the pin supporting member 22 by a length L4.

Moreover, the connector 20 includes a sleeve 23 which is installed on an outer circumference of the pin supporting member 22, is connected to the cable connection part 50, and includes stainless steel on which gold plating processing has been performed. Also, the connector 20 includes a shell 24 which is installed on an outer circumference of the sleeve 23, is connected to the cable connection part 50, and includes stainless steel. Also, the connector 20 includes a coupling nut 26 which is installed on an outer circumference of the shell 24, is rotatably attached on the shell 24 by interposing a C ring 25 including beryllium copper, and includes stainless steel on which passivating processing has been performed. Also, the connector 20 includes a coupling lock 28 which is rotatably attached on the shell 24 by interposing a C ring 27 including beryllium copper at the cable connection part 50 side rather than the coupling nut 26 and includes stainless steel on which passivating processing has been performed.

A spiral screw groove 26*a* to be screwed with a below-described female connector 30 is provided in an inner circumference surface of a front end portion (a left end portion of FIG. 7) of the coupling nut 26. Also, a spiral screw thread 26*b* to be screwed with the coupling lock 28 is provided on an outer circumference surface of a rear end portion (a right end portion of the drawing) of a cable connection part side of the coupling nut 26. Also, a screw groove 28*a* to be screwed with the above-described coupling nut 26 is provided on an inner circumference surface of a front end portion (a left end portion of the drawing) of the coupling lock 28.

The coupling nut 26 and the coupling lock 28 are rotatably attached on the shell 24 by respectively interposing the C rings 25 and 27 in a state where all of the coupling nut 26 and the coupling lock 28 are disposed in parallel in a lengthwise direction. The screw groove 26*a* of the coupling lock 28 is screwed with a screw thread of the coupling nut 26.

A locking part 24*a* elongating toward an outer side is provided along a circumference at a front end portion (a left end portion of the drawing) of the shell 24. Also, a ring groove 26*d* locking the C ring 25 is provided along a circumference in an inner circumference surface of an end portion (a right end portion of the drawing) of the cable connection part 50 side of the coupling nut 26. A space enabling the above-described locking part 24*a* to be movable in a lengthwise direction is provided in the coupling nut 26 by elongating up to a near-center portion of the coupling nut 26 in the lengthwise direction toward a front end portion side (a left end portion side of the drawing) from the ring groove 26*d*.

The space has a length L5 in the lengthwise direction. Therefore, by screwing the coupling lock 28 with the coupling nut 26, the shell 24 is pushed into the front end portion side (the left end portion side of the drawing) by interposing the C ring 27, and thus, the sleeve 23, the pin supporting member 22, and the pin 21 move to the front end portion side (the left end portion side of the drawing) by the length L5.

The length L4 and the length L5 are L4<L5.

Also, a stopper 26*c* which is provided along a circumference by elongating toward an inner portion and supports the sleeve 23 at a position apart from the sleeve 23 by a length of an interval D1 is provided at a near-center portion near the front end portion side (the left end portion side of the drawing) of an inner circumference surface of the coupling nut 26. Also, the above-described coupling nut 26 is installed in the shell 24 by interposing the C ring 25, and an interval D2 is provided between the C ring 25 and the shell 24, wherein interval D2> interval D1.

According to the above-described configuration, a position of the pin 21 is adjusted by the coupling lock 28. By rotating the coupling lock 28 clockwise (in a depth direction of the drawing) to move the coupling lock 28 toward a front end side (a left side of the drawing) of the connector 10 at a movable length L5, the pin 21 moves to the female connector 30 side by interposing the C ring 25, the shell 24, the sleeve 23, and the pin supporting member 22 on the basis of the movement of the coupling lock 28. Also, when the pin 21 moves to the most the female connector 30 side (a right side of the drawing) at the movable length L5, the pin of the male connector 20 moves to a position capable of being inserted into a pin hole of the female connector.

Figure 8A:
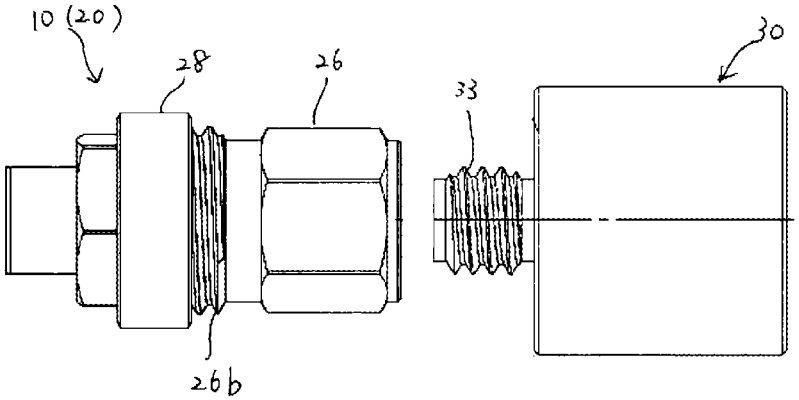
FIG. 8*a* is a side view showing a connecting state of a connector before a male connector is connected to a female connector according to an embodiment of the present invention.
Figure 8B:
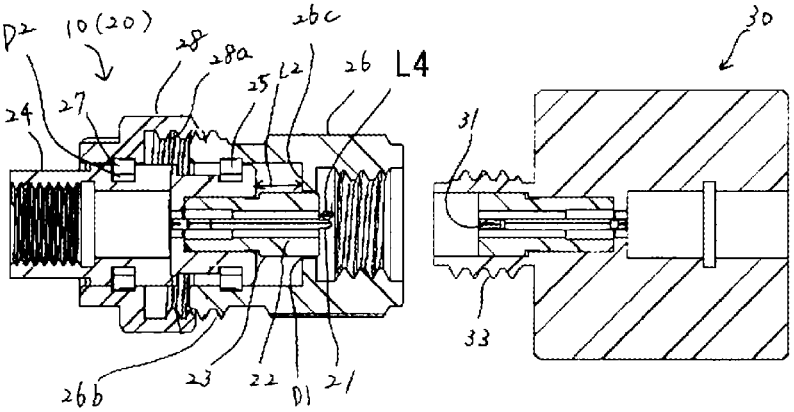
FIG. 8*b* is the cross-sectional side view showing the connecting state of FIG. 8*a*.
Figure 9A:
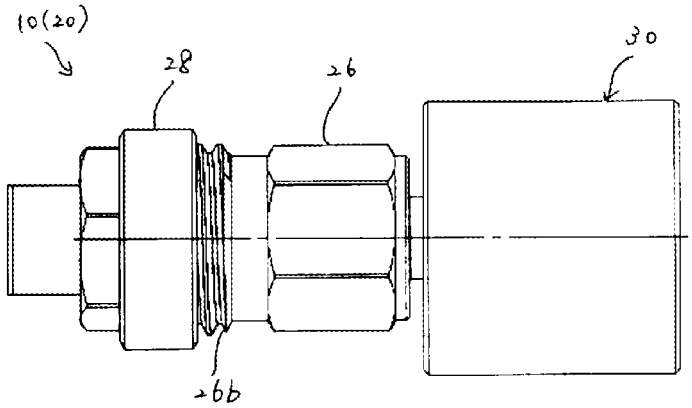
FIG. 9*a* is a side view showing a first connection state of a male connector and a female connector according to an embodiment of the present invention.
Figure 9B:
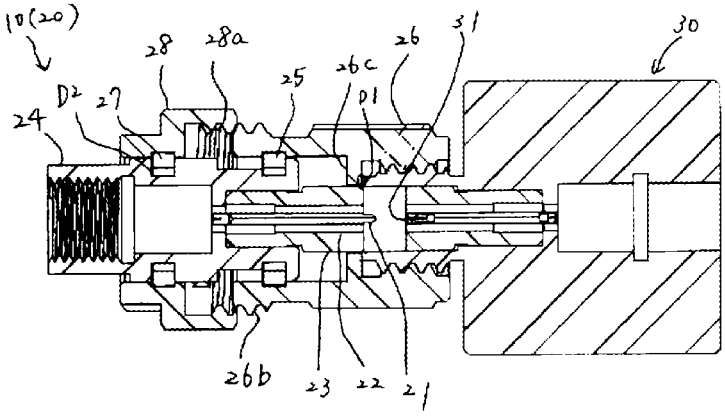
FIG. 9*b* is a cross-sectional side view showing the first connection state of FIG. 9*a*.
Figure 10A:
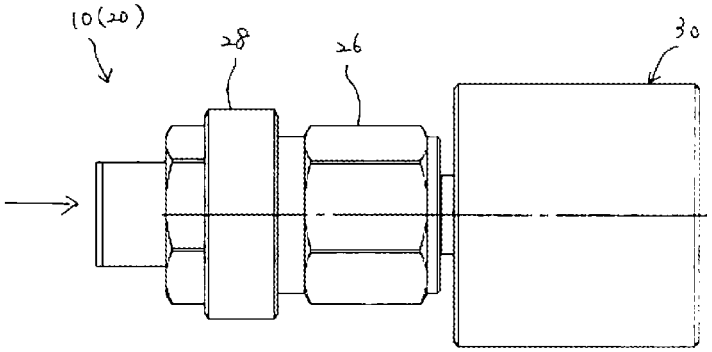
FIG. 10*a* is a side view showing a second connection state of a male connector and a female connector according to an embodiment of the present invention.
Figure 10B:
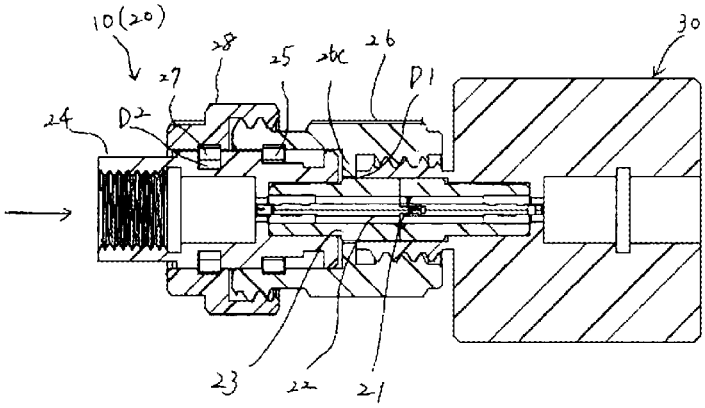
FIG. 10*b* is a cross-sectional side view showing the second connection state of FIG. 10*a*.

Subsequently, a connecting method of the male connector 20 and the female connector 30 will be described with reference to FIGS. 8 to 10. In FIGS. 8 to 10, a side view is illustrated in each drawing (a), and a side cross-sectional view is illustrated in each drawing (b). Also, in describing FIGS. 8 to 10, the same elements as those of FIGS. 6 and 7 are referred to by like reference numerals.

First, as illustrated in FIG. 8, the male connector 20 and the female connector 30 are prepared. At this time, the coupling lock 28 rotates counterclockwise (in a depth direction of the drawing), and thus, a position of the pin 21 moves in a direction opposite to the most the female connector 30 at the movable length L5.

Subsequently, as illustrated in FIG. 9, the screw groove 26*a* of the coupling nut 26 of the male connector 10 is screwed with a screw thread 34 of the female connector 30 by bringing the male connector 20 into contact with the female connector 30 (first connection). At this time, as described above, since the movable length L5 enabling the pin 21 to move in a lengthwise direction is greater than a length L4 of a pin protruding from the pin supporting part 22 (L4<L5), the pin is not connected to the pin hole 31 of the female connector 30 in a first connection state. Based on the first connection, the screw groove 26*a* of the coupling nut 26 of the male connector 10 is screwed with the screw thread 34 of the female connector 30, and rattling which is caused by a screw defect of a coupling nut and is a problem of the related art is solved.

Subsequently, a second connection for connecting the pin 21 to the pin hole 31 will be described with reference to FIG. 10. In the second connection, the coupling lock 28 of the male connector 20 rotates clockwise (in a just forward direction of the drawing) from the above-described first connection state. Therefore, a position of the pin 21 moves to the female connector 30 side (a right side of the drawing) at the movable length L5 and moves to the female connector 30 side by interposing the C ring 25, the shell 24, the sleeve 23, and the pin supporting part 22. Also, when the position of the pin 21 moves to the most the female connector 30 side (a left side of the drawing) at the movable length L5, the pin of the male connector 20 moves to a position capable of being inserted into the pin hole of the female connector, and the pin 21 is connected to the pin hole 31.

Based on the second connection, the coupling lock 28 may be screwed with the coupling nut 26, and a state where there is no rattling therebetween may be maintained. Therefore, based on the above-described first connection, rattling caused by screwing of the coupling nut 26 and the female connector 30 is solved, and by interposing the coupling nut 26, the coupling lock 28 is connected to the female connector in a state where axis-staggering is solved.

Moreover, as described above, an interval D1 between the sleeve 23 and the stopper 26*c* of the coupling lock 26 and an interval D2 formed between the C ring 25 and the shell 24 have a relationship "D2>D1", and in a state where axis-staggering of the coupling lock 28 and the female connector is solved, rattling caused by the interval D2 causing axis-staggering may decrease to D1 or less, whereby the axis-staggering may be more solved.

Figure 11:
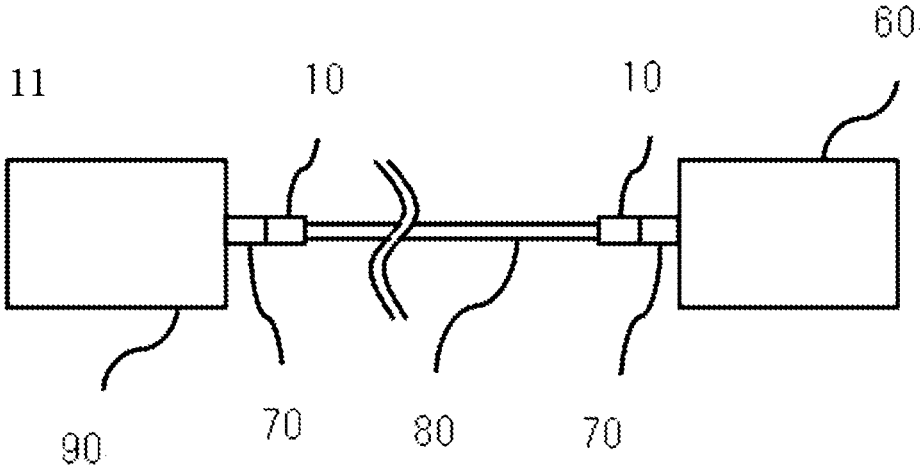
FIG. 11 is a schematic diagram illustrating an example of a device including a connector according to an embodiment of the present invention.
Figure 12:
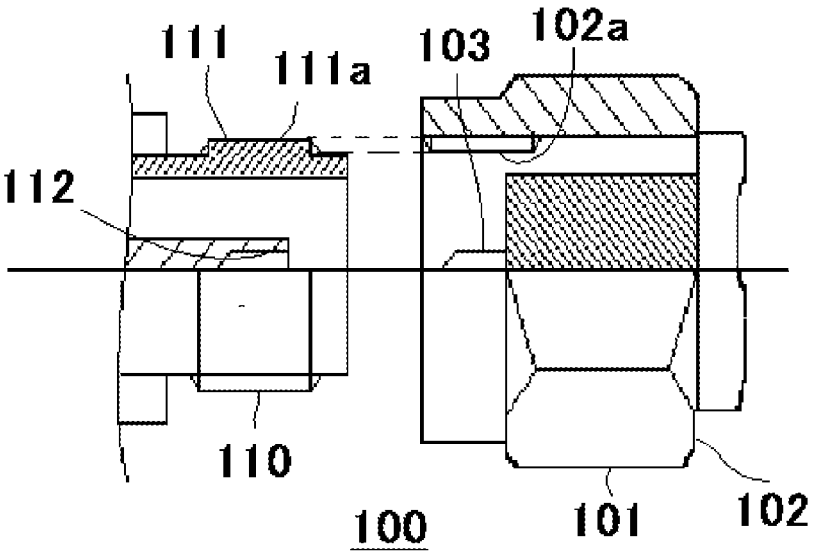
FIG. 12 is a diagram illustrating a connector of the related art and is a partial cross-sectional view for describing a general screwing-type connector.

FIG. 11 is a schematic diagram illustrating a device which includes a connector of the present invention and/or is manufactured by a manufacturing method including a connector connecting method of the present invention. A first device 90 is connected to a second device 60 by using a cable 80. At least one end of the cable 80 includes a connector 10 of the present invention, and the connector 10 is connected to another connector 70 including the device 60 and/or the device 90. Also, the connector 10 may be a connector including a pin hole, and the connector may be the connector of the present invention.

In an embodiment, the device 90 is a first operational unit, the device 60 is a second operational unit, and a computer system including the devices 60 and 90 is configured. In another embodiment, the device 90 is an operational unit, and the device 60 is a sensor or an actuator. Also, in another embodiment, the device 90 is an amplifier, and the device 60 is an antenna. Also, in another embodiment, the device 90 is a measurement device, and the device 60 is a material to be measured.

Since the devices or system include(s) the connector of the present invention and/or are/is manufactured by the manufacturing method including the connector connecting method of the present invention, high connection reliability or insertion/detachment workability having a low damage risk is realized.

Moreover, in each of the embodiments, an example where an electrical connection part including an internal conductor including a pin is configured to move with respect to a physical connection part is described, but the present invention is not limited thereto. In each of the embodiments, only a pin and a pin hole may be replaced. That is, an electrical connection part including an internal conductor including a pin hole may be configured to move with respect to a physical connection part. Even when another (connected) connector does not include a means for preventing the damage of the pin described in the present invention, namely, even when the includes a pin having a general configuration, the damage of the pin of the other connector caused by a contact between the pin hole and the pin may be prevented in performing a physical connection.

The embodiments illustrated herein are mere examples of the present invention and should therefore not be construed as being limiting. Alternatives provided by a skilled person in consideration of the embodiments are likewise encompassed by the scope of protection of the present invention. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. A connector comprising a connection part connected to a different connector at one end thereof and a cable connection part connected to a cable at the other end thereof, wherein the connection part comprises: an electrical connection part including an internal conductor including a pin elongating in a first direction; and a physical connection part provided outside the electrical connection part to fix a relative position with respect to the different connector in connecting the connector to the different connector, and the electrical connection part is configured to be movable in the first direction with respect to the physical connection part, wherein the connector is shifted from a first state, where a distance from a front end of the connection part to a front end of the pin is a first distance, to a second state where a distance from the front end of the connection part to the front end of the pin is a second distance less than the first distance, and wherein the pin comprises a pin body part and a pin front end portion provided at a front end side of the pin body part, the pin front end portion having a diameter reduced by the pin body part, and a difference between the first distance and the second distance is greater than a length of the pin front end portion in the first direction.

2. The connector of claim 1, wherein a difference between the first distance and the second distance is greater than a length of the pin in the first direction.

3. The connector of claim 1, further comprising a first lock mechanism maintaining the first state.

4. The connector of claim 1, further comprising a second lock mechanism maintaining the second state.

5. The connector of claim 1, wherein the physical connection part comprises a thread part and is configured to be screwed with the different connector by rotating the physical connection part in a first rotational direction.

6. The connector of claim 1, further comprising a state display means displaying the first state and/or the second state of the connector.

7. A method of connecting a connector, the method comprising the steps of:

preparing a first connector including one end, the other end, an internal conductor moving forward or backward with respect to a side of the one end, and a physical connection part provided near the internal conductor; preparing a second connector including one other internal conductor and one other physical connection part;

connecting the physical connection part of the first connector to the one other physical connection part of the second connector to fix a relative position of the first connector and the second connector; and moving forward the internal conductor of the first connector to electrically connect the internal conductor of the first connector to the one other internal conductor of the second connector, wherein the fixing of the relative position of the first connector and the second connector comprises placing the first connector and the second connector on the same axis.

8. The connecting method of claim 7, wherein the fixing of the relative position of the first connector and the second connector does not include electrically connecting the internal conductor of the first connector to the one other internal conductor of the second connector.

9. The connecting method of claim 7, wherein the fixing of the relative position of the first connector and the second connector does not include electrically connecting the internal conductor of the first connector to the one other internal conductor of the second connector.

* * * * *